US006790241B2

(12) United States Patent
Bechtold et al.

(10) Patent No.: US 6,790,241 B2
(45) Date of Patent: Sep. 14, 2004

(54) MEDIATOR SYSTEMS BASED ON MIXED METAL COMPLEXES, USED FOR REDUCING DYES

(75) Inventors: Thomas Bechtold, Dornbirn (AT); Eduard Burtscher, Bludenz (AT); Wolfgang Schrott, Böhl-Iggelheim (DE); Norbert Grund, Ludwigshafen (DE); Peter Maier, Stuttgart (DE); Georg Schnitzer, Nürnberg (DE); Franz Sütsch, Rödersheim-Gronau (DE)

(73) Assignee: DyStar Textilfarben GmbH & Co. Deutschland KG (DE)

( * ) Notice: Subject to any disclaimer, the term of this patent is extended or adjusted under 35 U.S.C. 154(b) by 15 days.

(21) Appl. No.: 10/220,071

(22) PCT Filed: Mar. 1, 2001

(86) PCT No.: PCT/EP01/02307

§ 371 (c)(1),
(2), (4) Date: Oct. 15, 2002

(87) PCT Pub. No.: WO01/64999

PCT Pub. Date: Sep. 7, 2001

(65) Prior Publication Data

US 2003/0088926 A1 May 15, 2003

(30) Foreign Application Priority Data

Mar. 2, 2000 (DE) ..... 100 10 060

(51) Int. Cl.[7] ..... D06P 1/30; D06P 1/22

(52) U.S. Cl. ..... 8/599; 8/611; 8/618; 8/650; 8/652; 8/653; 8/918

(58) Field of Search ..... 8/599, 611, 618, 8/650, 652, 653, 918; 205/691

(56) References Cited

U.S. PATENT DOCUMENTS

| | | | |
|---|---|---|---|
| 5,244,549 | A | 9/1993 | Bechtold |
| 5,443,599 | A | 8/1995 | Bechtold |
| 5,586,992 | A | 12/1996 | Schnitzer et al. |

FOREIGN PATENT DOCUMENTS

| | | |
|---|---|---|
| DE | 42 06 929 | 9/1993 |
| DE | 43 20 866 | 1/1995 |
| DE | 43 20 867 | 1/1995 |
| DE | 199 19 746 | 11/2000 |
| WO | WO 90/15182 | 12/1990 |
| WO | WO 92/09740 | 6/1992 |
| WO | WO 94/23114 | 10/1994 |
| WO | WO 95/07374 | 3/1995 |
| WO | WO 96/32445 | 10/1996 |

*Primary Examiner*—Margaret Einsmann
(74) *Attorney, Agent, or Firm*—Connolly Bove Lodge & Hutz LLP

(57) ABSTRACT

Mediator systems obtainable by mixing a salt of an electrochemically active complexing metal (M1) capable of forming a plurality of valence states with a hydroxyl-containing complexing agent, which may likewise be present as salt, and with a salt of an electrochemically inactive complexing metal (M2) in an alkaline aqueous medium, wherefor the molar ratio of metal ion M2 to metal ion M1 is from 0.8:1 to 2:1 are useful for reducing dyes and dyeing cellulosic textile material.

11 Claims, No Drawings

MEDIATOR SYSTEMS BASED ON MIXED METAL COMPLEXES, USED FOR REDUCING DYES

This application is a 371 of PCT/EP01/02307 filed Mar. 1, 2001.

The present invention relates to mediator systems obtainable by mixing a salt of an electrochemically active complexing metal (M1) capable of forming a plurality of valence states with a hydroxyl-containing complexing agent, which may likewise be present as salt, and with a salt of an electrochemically inactive complexing metal (M2) in an alkaline aqueous medium, wherefor the molar ratio of metal ion M2 to metal ion M1 is from 0.8:1 to 2:1.

The invention also provides a process for reducing dyes, a process for dyeing cellulosic textile material using these mediator systems and cellulosic textile materials dyed by these processes.

Vat dyes and sulfur dyes are important classes of textile dyes.

Vat dyes are of major significance for dyeing cellulose fibers on account of the high fastnesses of the dyeings in particular. To use these dyes, the insoluble oxidized dye has to be converted into its alkali-soluble leuco form by a reducing step. This reduced form has high affinity for cellulose fiber, goes onto the fiber and once on the fiber is converted back into its insoluble form by an oxidizing step.

The class of sulfur dyes is particularly important for the production of inexpensive dyeings having average fastness requirements. The use of sulfur dyes likewise involves the need to carry out a reducing step and an oxidizing step in order that the dye may be fixed on the material.

The literature describes a wide range of reducing agents for use on an industrial scale, eg. sodium dithionite, organic sulfinic acids, organic hydroxy compounds such as glucose or hydroxyacetone. In some countries sulfur dyes are still being reduced using sulfides and polysulfides.

A feature common to these reducing agents is the absence of a suitable way for regenerating their reducing effect, so that these chemicals are discharged after use into the wastewater together with the dyebath. As well as the costs for fresh chemicals to be used, this also creates the additional expense of having to treat the wastewaters produced.

Further important disadvantages of these reducing agents are the very limited means to influence their reducing effect or their redox potential under application conditions in the dyebath and the absence of simple control technology for regulating the dyebath potential.

A further group of reducing agents was discovered in the class of iron(II) complexes. Iron(II) complexes are known with triethanolamine (WO-A-90/15182, WO-A-94/23114), with bicine (N,N-bis(2-hydroxyethyl)glycine) (WO-A-95/07374), with triisopropanolamine (WO-A-96/32445) and also with aliphatic hydroxy compounds which may contain a plurality of hydroxyl groups and may additionally be functionalized with aldehyde, keto or carboxyl, such as di- and polyalcohols, di- and polyhydroxyaldehydes, di- and polyhydroxyketones, di- and polysaccharides, di- and polyhydroxymono- and -dicarboxylic acids and also hydroxytricarboxylic acids, preference being given to sugar-based compounds, especially the acids and salts thereof, eg. gluconic and heptagluconic acid, and citric acid (DE-A42 06 929, DE-A-43 20 866, DE-A-43 20 867, prior German patent application DE-A-199 19 746, unpublished at the priority date of the present invention, and also WO-A-92/09740).

These iron(II) complexes have a reducing effect which is sufficient for dye reduction and which is described by the (negative) redox potential which is measurable in alkaline solution at a certain molar ratio of iron(II):iron(III). Numerous of these iron(II) complexes, eg. the complexes with triethanolamine, bicine, gluconic acid and heptagluconic acid, also have the advantage of being electrochemically regenerable and hence of usefulness as mediators in an electrochemical reduction of dyes and also in electrochemical dyeing processes.

It is further known to use mixtures of these iron complexes as reducing agents. For instance, textil praxis international, 47, pages 44–49 (1992) and Journal of the Society of Dyers and Colourists, 113, pages 135–144 (1997) describe mixtures of iron salts, triethanolamine and respectively citric acid or gluconic acid. The latter paper also utilizes as mediators mixtures of iron salts, calcium salts and gluconic acid and/or heptagluconic acid where the molar ratio of calcium to iron is in the range from 0.5 to 0.75.

However, the known mediator systems have certain weaknesses. True, the iron complexes based on triethanolamine or bicine have a sufficiently negative redox potential for dye reduction, but they are not sufficiently stable in the more weakly alkaline region at pH$\leqq$11.5, which greatly limits their electrochemical regenerability in indigo dyebaths for denim manufacture. True, the mediator systems based on gluconate or heptagluconate have very good complex stability in the pH range of 10–12, but the known systems have to have a relatively large fraction of iron(II) complex to achieve a redox potential of $\leqq$−700 mV (Ag/AgCl, 3 M KCl reference electrode), as is required, for example, to maintain the requisite bath stability for dyeing with indigo. But the large fraction of iron(II) complex required is disadvantageous especialy with regard to dyeing with indigo in denim manufacture, since the textile material is here dyed layer by layer by repeated immersion in the dyebath and subsequent air oxidation of the dye, so that the mediator in the dyebath is completely oxidized with every air passage and first has to be reduced again for the next dyeing cycle, and this entails high electricity consumption, which in turn requires high mediator concentrations or correspondingly large electrolytic cells by way of compensation.

It is an object of the present invention to remedy the disadvantages mentioned and to make it possible to reduce dyes in an advantageous, economical manner. More particularly, stable mediator systems having a powerful reducing action shall be provided.

We have found that this object is achieved by the mediator systems defined at the beginning.

The invention also provides a process for electrochemical reduction of dyes in an alkaline aqueous medium and also a process for dyeing cellulosic textile material with vat dyes or sulfur dyes by electrochemical dye reduction in the presence of metal complexes as mediators, which each comprise using the mediator systems defined at the beginning.

The invention lastly provides cellulosic textile materials which have been dyed by this process.

An essential feature of the mediator systems according to the invention is a combination of the electrochemically active metal ion M1 with an electrochemically inactive, but likewise complexation-capable metal ion M2 and with a hydroxyl-containing but amino-devoid complexing agent in a molar ratio of metal ion M1 to metal ion M2 of from 0.8:1 to 2:1, preferably from 0.9:1 to 1.1:1, particularly preferably about 1:1.

The mediator systems according to the invention are obtainable by mixing the individual components, which may be used in the form of their water-soluble salts, in an alkaline aqueous medium, which generally has a pH of about 10–14. In the course of the mixing, the metal ions M1 and M2 are at least partially complexed, preferably forming an approximately equimolar complex.

The amount of complexing agent is not critical and has only minor importance given a predetermined ratio of reduced to oxidized form of the metal ion M1. The minimum amount of complexing agent normally used will be the amount theoretically required for completely complexing M1, ie. at least 0.5 mol, preferably 1 mol per mole of M1. In principle there is no upper limit to this molar ratio, but cost reasons will generally rule out the use of an amount of more than 5 mol, especially 3 mol, in particular 1.5 mol, of complexing agent per mole of M1.

The metal ion M1 can be used not only in low-valent form but also in higher-valent form. For example, in the case of the particularly preferred metal iron, not only iron(II) salts may be used but also iron(III) salts, which are initially readily reduced to iron(II) electrochemically.

Useful hydroxyl-containing complexing agents for the purposes of the invention include in particular aliphatic hydroxy compounds that have at least two coordination-capable groups and that are likewise soluble in water or aqueous organic media or miscible with water or aqueous organic media and that may contain a plurality of hydroxyl groups and/or aldehyde, keto and/or carboxyl groups. Specific examples of preferred complexing agents are:

- di- and polyalcohols such as ethylene glycol, diethylene glycol, pentaerythritol, 2,5-dihydroxy-1,4-dioxane, especially sugar alcohols such as glycerol, tetritols such as erythritol, pentitols such as xylitol and arabitol, hexitols such as mannitol, dulcitol, sorbitol and galactitol;
- di- and polyhydroxyaldehydes such as glyceraldehyde, triose reductone, especially sugars (aldoses) such as mannose, galactose and glucose;
- di- and polyhydroxyketones such as, in particular, sugars (ketoses) such as fructose;
- di- and polysaccharides such as sucrose, maltose, lactose, cellubiose and molasses;
- di- and polyhydroxymonocarboxylic acids such as glyceric acid, particularly acids derived from sugars, such as gluconic acid, heptagluconic acid, galactonic acid and ascorbic acid;
- di- and polyhydroxydicarboxylic acids such as malic acid, particularly sugar acids such as glucaric acids, mannaric acids and galactaric acid;
- hydroxytricarboxylic acids such as citric acid.

Particularly preferred complexing agents are the monocarboxylic acids derived from sugars (especially gluconic acid and heptagluconic acid) and their salts, esters and lactones.

It will be appreciated that it is also possible to use mixtures of complexing agents. A particularly useful example thereof is a mixture of gluconic acid and heptagluconic acid, preferably in a molar ratio of from 0.1:1 to 10:1, which provides iron complexes that are particularly stable at high temperatures.

The metal ion M2 is preferably a metal ion which likewise will form stable complexes with the complexing agent of the invention. Particular preference is given to divalent metal ions, and calcium ions are very particularly preferred.

In particularly preferred mediator systems according to the invention the metal ion M1 comprises iron(II/III) ions, the metal ion M2 comprises calcium ions and the complexing agent is gluconic acid and/or heptagluconic acid.

The particular advantages of the mediator systems according to the invention are that they have a redox potential <−700 mV not only in the pH range customary for dye reduction (about 12.5–13.5), but also at a lower concentration of low-valent metal ion M1 and hence at a lower concentration of active complex, but will form a stable complex system even at lower pH values, ie. at about 11–12, and so are altogether very useful as mediators for electrochemical dyeing with indigo in particular.

That the redox potential of the electrochemically active complex would so distinctly shift to what are more negative values in the presence of the electrochemically inactive metal ion was unexpected. To illustrate this effect, the redox potentials determined by means of electrochemical conversion trials for a mediator system of iron, calcium and gluconate ions are reported in what follows. The respective iron(II)/iron(III) ratio was determined photometrically using 1,10-phenanthroline.

| Measurement # | Iron mol/l | Gluconate mol/l | Calcium mol/l | pH | Fe(II): Fe(III) | Potential mV |
|---|---|---|---|---|---|---|
| 1 | 0.1 | 0.2 | 0.1 | 12.6 | 0.071 | −766 |
| C1 | 0.1 | 0.2 | — | 12.6 | 0.085 | −592 |
| 2 | 0.1 | 0.2 | 0.1 | 12.6 | 0.164 | −826 |
| C2 | 0.1 | 0.2 | — | 12.7 | 0.163 | −671 |
| 3 | 0.1 | 0.2 | 0.1 | 12.7 | 0.245 | −855 |
| C3 | 0.1 | 0.2 | — | 12.8 | 0.240 | −698 |

The mediator systems of the invention are very useful for the electrochemical reduction of dyes.

The process of the invention is particularly important for reducing vat dyes and sulfur dyes, particularly the class of indigoid dyes, the class of anthraquinonoid dyes, the class of dyes based on highly fused aromatic ring systems and the class of sulfur cooking and baking dyes. Examples of vat dyes are indigo and its bromine derivatives, 5,5'-dibromoindigo and 5,5',7,7'-tetrabromoindigo, and thioindigo, acylaminoanthraquinones, anthraquinoneazoles, anthrimides, anthrimidecarbazoles, phthaloylacridones, benzanthrones and indanthrones and also pyrenequinones, anthanthrones, pyranthrones, acedianthrones and perylene derivatives. Examples of particularly important sulfur dyes are C.I. Sulfur Black 1 and C.I. Leuco Sulfur Black 1 and sulfur vat dyes such as C.I. Vat Blue 43.

The inventive process for reducing the dye customarily employs the mediator in an amount not more than approximately that required by the dye reduction stoichiometry. So one mole of an oxidized dye which takes up two electrons per molecule to convert into the leuco form generally requires, 2 mol of a mediator system according to the invention, based on the redox-active metal ion supplying one electron. It will be appreciated that electrochemical regeneration of the mediator can reduce this mediator quantity (in the case of dyeing with vat dyes generally to about 0.1–1 mol of reduced mediator per mole of dye, based on one liter of dyebath). The greater the deficiency of mediator system, the higher the requirements the electrolytic cell has to meet.

The reduction process of the invention can advantageously be part of the similarly inventive process for dyeing cellulosic textile material with vat and sulfur dyes. Preferably, in this case, the dye is added to the dyebath in prereduced form, for example in the form of an alkaline solution of catalytically reduced indigo, and the dye fraction reoxidized by air contact during dyeing is electrochemically reduced by means of the mediator systems according to the invention.

The dyeing itself may be carried out as described in the references cited at the beginning. Any known continuous and batch dyeing methods, for example the exhaust method and the padding method, may be employed.

Because different dyeing processes and dyeing machines differ in the degree of air access they allow, there will be some instances where appreciable quantities of mediator system have to be used to cope with the oxygen from the air. For instance, exhaust dyeing with vat dyes to medium depths of shade will impose an additional requirement of about 1–10 mol of reduced mediator per mole of dye, while continuous dyeing with indigo additionally requires about 2–10 mol of reduced mediator per mole of indigo.

The rest of the process conditions, such as type of textile assistants, use levels, dyeing conditions, type of electrolytic cell and finishing of the dyeings, can be chosen as customary and as described in the references cited at the beginning.

The dyeing process of the invention provides advantageous dyeing on all cellulosic textile materials. Examples are fibers composed of cotton, regenerated cellulose such as viscose and modal and bast fibers such as flax, hemp and jute. Useful processing forms include for example staple, tow, yam, thread, wovens, loop-drawn knits, loop-formed knits and made-up pieces. Machine forms can be pack systems, hank, package, warp beam, fabric beam and piece goods in rope form or open width.

EXAMPLE

Dyeing with indigo in denim manufacture 250 ends of cotton yam (Nm 11.4, Ne 6.75/1) were dyed with indigo on a laboratory dyeing range (from Looptex, Lugano, Switzerland) which was coupled to an electrolytic cell and is suitable for dyeing cotton yarn by the sheet dyeing and the rope dyeing process.

The electrolytic cell was a multicathode cell (10 electrodes, 400 cm2 planar surface area, total surface area 1.9 m2). The anolyte used was 5% by weight sulfuric acid. Catholyte (dyebath) and anolyte were kept apart by a cation exchange membrane. The cathode used was a stainless steel mesh, while the anode used was a titanium electrode coated with platinum mixed oxide.

The dyeing was carried out as follows:

The cotton yarn was initially prewetted in a cold wetting agent liquor (3 g/l of a commercially available wetting agent) and, after squeezing off to 75% wet pickup, dipped into the hereinbelow-described dyebath (11.25 l, room temperature). After a dip time of about 25 sec and squeezing off to 75% wet pickup, the yarn was air oxidized at room temperature for 120 sec. The cycle of dipping in the dyebath, squeezing off and air oxidization was repeated a number of times. Thereafter, the dyed yarn was rinsed with deionized water and dried.

The dyebath, which had been adjusted to pH 11.3, had the following composition:

0.24 mol/l of iron(III) chloride (40% by weight aqueous solution; 68.5 ml/l)
0.30 mol/l of sodium gluconate (99%; 65.4 g/l)
0.12 mol/l of sodium heptagluconate (22.5% by weight aqueous solution, 115 ml/l)
0.24 mol/l of calcium chloride (78.5% by weight aqueous solution; 29.6 g/l)
1.15 mol/l of aqueous sodium hydroxide solution (50% by weight; about 63 ml/l).

The dyebath was reduced prior to the start of dyeing. After 5 minutes of electrolysis at 5 A a potential of −700 mV was reached, the cell voltage being 6.6 V. A 20% by weight alkaline aqueous leuco indigo solution (BASF) was then introduced into the reduced dyebath, which was then used for dyeing.

The following 3 series were dyed with respectively 4, 6 and 8 cycles (3 dyeings in each case):

1st series:

45 ml of leuco indigo solution (corresponding to 1 g of indigo/l of dyebath), pH in dyebath 11.35.

2nd series:

90 ml of leuco indigo solution (corresponding to 2 g of indigo/l of dyebath), pH in dyebath 11.4.

3rd series:

180 ml of leuco indigo solution (corresponding to 4 g of indigo/l of dyebath), pH in dyebath 12.5.

The dyeings obtained were of outstanding quality being equivalent in depth of shade and penetration to standard dyeings with hydrosulfite as reducing agent.

What is claimed is:

1. Mediator systems obtainable by mixing a salt of an electrochemically active complexing metal (M1) capable of forming a plurality of valence states with a hydroxyl-containing but amino devoid complexing agent, which may likewise be present as salt, and with a salt of an electrochemically inactive complexing metal (M2) in an alkaline aqueous medium, wherefor the molar ratio of metal ion M2 to metal ion M1 is from 0.8:1 to 2:1.

2. Mediator systems as claimed in claim 1, containing iron(II) ions and/or iron(III) ions as metal ion M1.

3. Mediator systems as claimed in claim 1, wherein said M2 contains divalent metal ions.

4. Mediator systems as claimed in claim 1, wherein said M2 contains calcium ions.

5. Mediator systems as claimed in claim 1, wherein said complexing agent is a hydroxyl-containing aliphatic carboxylic acid.

6. Mediator systems as claimed in claim 1, wherein said metal ion M1 comprises iron (II/III) ions, said metal ion M2 comprises calcium ions and said complexing agent is gluconic acid and/or heptagluconic acid.

7. A process for electrochemical reduction of dyes in an alkaline aqueous medium using metal complexes as mediators, which comprises using the mediator system as claimed in claim 1.

8. The process as claimed in claim 7, wherein said dyes are vat dyes or sulfur dyes.

9. A process for dyeing cellulosic textile material with vat dyes or sulfur dyes which comprises an electrochemical dye reduction in the presence of the mediator system as claimed in claim 1.

10. The process as claimed in claim 9, wherein the dye is added to the dyebath in prereduced form and the dye fraction reoxidized by air contact during dyeing electrochemically reduced by means of the mediator system.

11. Cellulosic textile materials dyed by the process of claim 10.

* * * * *

UNITED STATES PATENT AND TRADEMARK OFFICE

CERTIFICATE OF CORRECTION

PATENT NO. : 6,790,241 B2 
APPLICATION NO. : 10/220071
DATED : September 14, 2004
INVENTOR(S) : Bechtold et al.

It is certified that error appears in the above-identified patent and that said Letters Patent is hereby corrected as shown below:

On the TITLE page,

[*] Notice: Subject to any disclaimer, the term of this patent is extended or adjusted under 35 USC 154(b) by (15) days Delete the phrase "by 15" and insert -- by 45 days--

Signed and Sealed this

Twenty-sixth Day of December, 2006

JON W. DUDAS
*Director of the United States Patent and Trademark Office*